United States Patent [19]

McDaniel et al.

[11] Patent Number: 4,458,452

[45] Date of Patent: Jul. 10, 1984

[54] CONTROL FOR GRINDING MACHINE

[75] Inventors: George H. McDaniel, Northville; William R. Hungerford, Detroit, both of Mich.

[73] Assignee: The Bendix Corporation, Southfield, Mich.

[21] Appl. No.: 374,578

[22] Filed: May 3, 1982

[51] Int. Cl.[3] ..... B24B 49/00

[52] U.S. Cl. ..... 51/165 TP; 51/105 SP; 51/289 R

[58] Field of Search ..... 51/165 R, 165 TP, 165.71, 51/289 R, 105 SP; 364/474

[56] References Cited

U.S. PATENT DOCUMENTS

| | | | |
|---|---|---|---|
| 3,344,559 | 10/1967 | Seiuemon | 51/165 TP |
| 4,186,529 | 2/1980 | Huffman | 51/165 TP |
| 4,205,488 | 6/1980 | Englander | 51/289 R |

FOREIGN PATENT DOCUMENTS

| | | | |
|---|---|---|---|
| 1367091 | 9/1974 | United Kingdom | 51/165.71 |

*Primary Examiner*—Harold D. Whitehead

*Attorney, Agent, or Firm*—Markell Seitzman; Russel C. Wells

[57] ABSTRACT

A control for a grinding machine of the type having a grinding wheel mounted at an oblique angle relative to a workpiece, the control including means for receiving first data representative of a contour to be ground on the workpiece defined in a first set of axes in a workpiece coordinate system, means for transforming the first data into a set of second data defined in a second set of axes relative to the grinding wheel and means for generating output signals to cause the grinding wheel to grind a predefined contour on the workpiece in accordance with the second data.

2 Claims, 3 Drawing Figures

CONTROL FOR GRINDING MACHINE

BACKGROUND AND SUMMARY OF THE INVENTION

Grinding machines, especially the class of machines such as the STEP-MASTER manufactured by Warner & Swasey of Cleveland, Ohio were designed with the plane of the grinding wheel mounted at an oblique angle with respect to the workpiece. This type of machine can be used to grind as an example, the inside of a shoulder or a fillet radius. This type of arrangement is shown in FIG. 1 which illustrates the workpiece generally designated as 16 having a shoulder or fillet radius 12. The grinding wheel 18 mounted at an oblique angle $\phi$. The grinding wheel 18 may be dressed or shaped to the desired shape of the interior dimension of the shoulder. An advantage of this design is that the workpiece 16 and wheel 18 can be moved into contacting engagement by motion about a single axis that is movement parallel to the plane of the grinding wheel.

The inclusion of computer numerical controls to these machines has heretofore done little to alleviate the limitation of these machines caused by the oblique mounting of the grinding implements such as the wheel 14 relative to the workpiece. Known techniques of circular interpolation for cutting circles and other continuous curves are not directly applicable to this type of machine because of the oblique mounting of the grinding implement.

An object of the present invention is to provide a numerical control system for a grinding machine of the type having an obliquely mounted grinding implement. A further object of the present invention is to provide this numerical control system with a capability of controlling the obliquely mounted grinding implement or for controlling the relative relationship of the workpiece and the grinding implement such that contouring can be readily performed by the obliquely mounted grinding implement.

Many other objects and purposes of the invention will be clear from the following detailed description of the drawings.

DETAILED DESCRIPTION OF THE DRAWINGS

Figure 1:
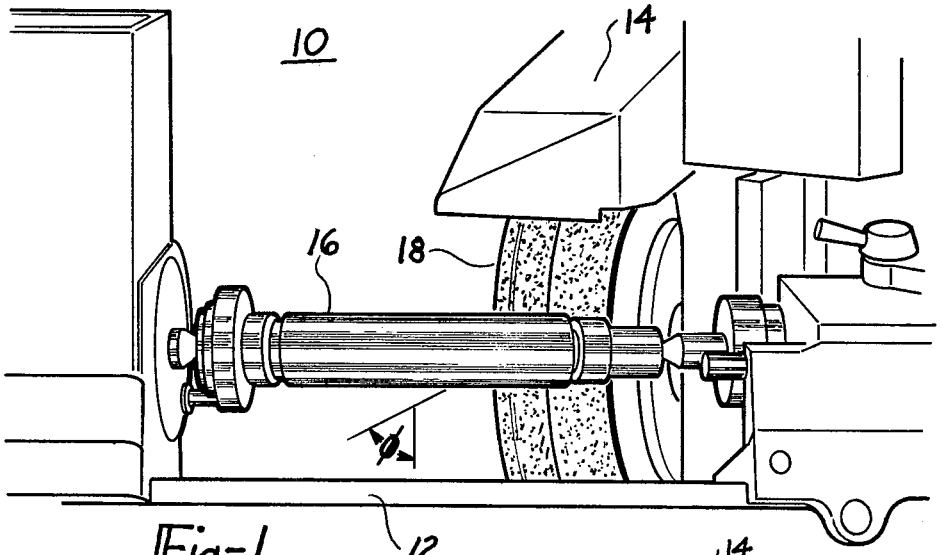
FIG. 1 illustrates a grinding machine having an obliquely mounted grinding implement.

Reference is made to FIG. 1 which illustrates a grinder 10 having a first slide 12 and a second slide 14. A workpiece 16 is mounted to the first slide 12 in a known manner relative to a movable grinding implement 18 mounted to the second slide 14. Alternatively, the workpiece 16 can be mounted in a non-translatory position and the grinding implement 18 mounted to be moveable along the slides 12 and 14 shown in phantom line in FIG. 2 relative to a non-translating workpiece. The grinding implement 18 is mounted at an oblique angle $\phi$ relative to the workpiece 16. The workpiece 16 or the grinding implement 18 can be rotated about its respective axis of rotation. A first coordinate system is defined in the workpiece having its $Z_1$ axis parallel to the axis of rotation of the workpiece and having its $X_1$ axis perpendicular thereto forming an orthogonal coordinate system hereinafter referred to as "part or workpiece coordinates." A second coordinate system ($X_2$, $Z_2$) which generally may not be an orthogonal coordinate system is defined as "slide or grinder coordinates." The relationship between the part coordinates and the slide coordinates is more clearly illustrated in FIG. 2. To control the relative motion between the workpiece 16 and the grinding implement 18 a part program must be defined. Part programming is most conveniently performed in an orthogonal coordinate axis system such as that defined by the part coordinate system ($X_1$, $Z_1$). In this coordinate system a conventional contour such as a circle is straightforward to mathematically define and will appear circular in shape when viewed in the part coordinate system. The mathematical relationship between the part coordinates and the slide coordinates is defined by equation 1 below wherein the transformation matrix T can be shown to be:

$$T = \begin{bmatrix} \frac{1}{\sin\phi} & 0 \\ \frac{-\cos\phi}{\sin\phi} & 1 \end{bmatrix} \tag{1}$$

The angle $\phi$ relating the slide coordinates to the part coordinates will typically be a determinable and most often a fixed angle.

Figure 2:
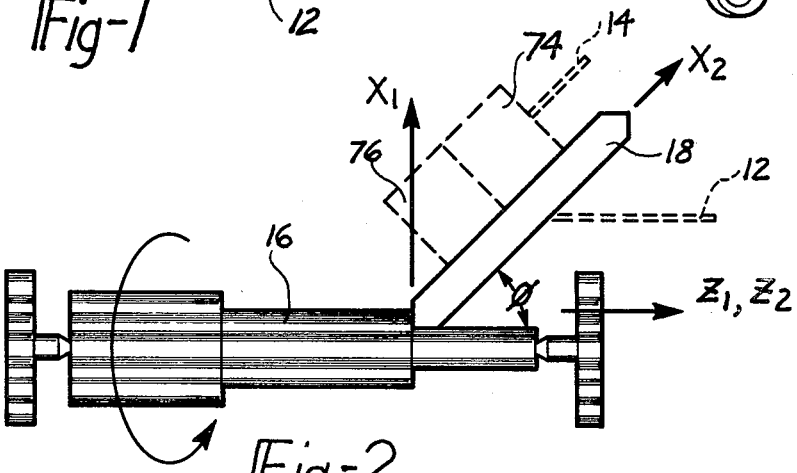
FIG. 2 is a top plan view further illustrating the relationship between the grinding implement and workpiece.
Figure 3:
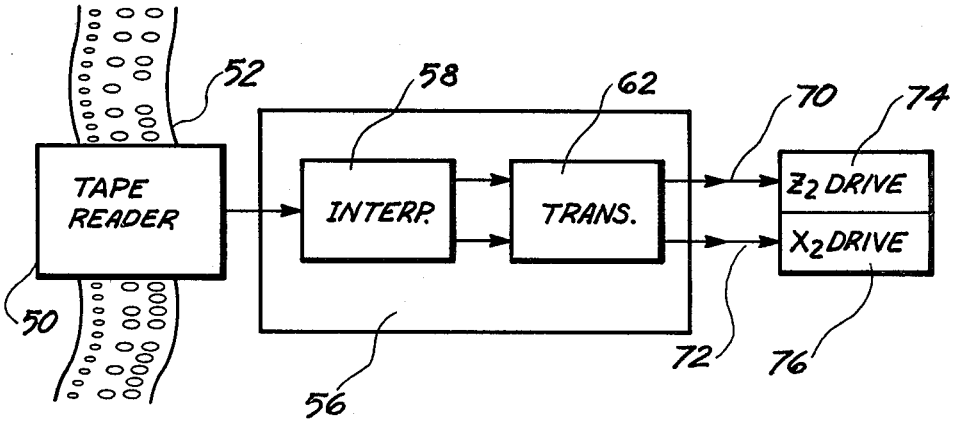
FIG. 3 is a block diagram of a control system for a grinding wheel.

Reference is now made to FIG. 3 which illustrates a block diagram of the present system. Information relating to the desired contour to be ground by the grinding implement 18 onto the workpiece 16 is coded in digital form and represented in the part coordinate system ($X_1$, $Z_1$) on an input media such as a disk or tape 50. The tape 50 is passed through a reading device generally shown as a tape reader 52 to generate a series of electrical signals representative of the coded information. These electrical signals would represent position coordinates $x_1$, $z_1$ in the ($X_1$, $Z_1$) part coordinate system or represent series of pulse trains, data or other singals each of which is indicative of a desired coordinate position and is operative to control each axis of motion between the grinding implement 18 and the workpiece 16. More particularly the output of the tape reader 52 is received by a control 56 comprising an interpolator 58. The output of the interpolator 58 would be the series of electrical pulses defining the relative motion between the grinding implement 18 and workpiece 16 as viewed in the first or part coordinate system ($X_1$, $Z_1$). In order to satisfactorily utilize this information which had been programmed in the part coordinate system, the controller 56 further includes a means for transforming the received data into the slide or grinder coordinate system ($X_2$, $Z_2$). This transformation means is generally designated as 62. The output of the transformation means 62 is a series of data or pulses that represent the desired contour to be ground however represented in the slide or grinder coordinate system ($X_2$, $Z_2$). These pulses, data or signals are output in lines 70 and 72 to the motor drives 74 and 76 of the slides 12 and 14 respectively. Alternatively, the motor drives 74 and 76 can be mounted in a known manner to the second slide 14 as shown in FIG. 2 such that the grinding implement 18 can be moved in the ($X_2$, $Z_2$) coordinate system relative to a non-translating workpiece 16.

Many changes and modifications in the abovedescribed embodiment of the invention can of course be carried out without departing from the scope thereof. Accordingly, that scope is intended to be limited only by the scope of the appended claims.

What is claimed is:

1. In a numerically grinding machine having holding means adapted to engage and hold a workpiece relative to a first set of orthogonal axes ($X_1$, $Z_1$), means for grinding said workpiece including a grinding implement or wheel mounted relative a second set of axes ($X_2$, $Z_2$), means for moving the workpiece or said grinding implement relative to one another;

means for receiving first data representative of a contour to be ground into the workpiece defined in said first set of axes;

means for transforming said first data into a set of second data defined in said second set of axes; and means for generating output signals to said moving means to cause said grinding implement to grind said contour on said workpiece in accordance with said second data.

2. The system as defined in claim 1 wherein said second set of axes is rotated relative to said first set of axes by a determinable angle ($\phi$) and wherein said transforming means generates said second set of data in accordance with the following relationship:

$$\begin{bmatrix} x_2 \\ z_2 \end{bmatrix} = \begin{bmatrix} \frac{-1}{\sin\phi} & 0 \\ \frac{-\cos\phi}{\sin\phi} & 1 \end{bmatrix} \begin{bmatrix} x_1 \\ z_2 \end{bmatrix}$$

wherein $x_1$, $y_1$, are data in said first set of axes $X_1$, $Z_1$ and wherein $x_2$, $z_2$ are data in said second set of axes $X_2$, $Z_2$.

* * * * *